US009656400B2

(12) United States Patent
Krenik

(10) Patent No.: US 9,656,400 B2
(45) Date of Patent: May 23, 2017

(54) HAIR CUTTING TECHNIQUES FOR AUTOMATED HAIR CUTTING SYSTEM

(71) Applicant: Matthew W. Krenik, Garland, TX (US)

(72) Inventor: Matthew W. Krenik, Garland, TX (US)

( * ) Notice: Subject to any disclaimer, the term of this patent is extended or adjusted under 35 U.S.C. 154(b) by 8 days.

(21) Appl. No.: 14/534,411

(22) Filed: Nov. 6, 2014

(65) Prior Publication Data

US 2015/0059187 A1 Mar. 5, 2015

Related U.S. Application Data

(63) Continuation-in-part of application No. 14/086,497, filed on Nov. 21, 2013, now abandoned.

(60) Provisional application No. 61/901,093, filed on Nov. 7, 2013, provisional application No. 61/925,567, filed on Jan. 9, 2014, provisional application No. 61/728,851, filed on Nov. 21, 2012, provisional application No. 61/780,086, filed on Mar. 13, 2013.

(51) Int. Cl.

| | |
|---|---|
| ***B26B 19/38*** | (2006.01) |
| ***B26B 19/42*** | (2006.01) |
| ***B26B 21/40*** | (2006.01) |

(52) U.S. Cl.

CPC ..... *B26B 19/388* (2013.01); *B26B 19/3806* (2013.01); *B26B 19/3846* (2013.01); *B26B 19/42* (2013.01); *B26B 21/4081* (2013.01); *Y10T 83/141* (2015.04)

(58) Field of Classification Search

CPC ... B26B 19/388; B26B 21/4081; B26B 19/42; B26B 19/3806; B26B 19/3846; Y10T 83/141

See application file for complete search history.

(56) References Cited

U.S. PATENT DOCUMENTS 1,596,241 A * 8/1926 Donnellon ..... B26B 19/066 30/223
1,598,737 A * 9/1926 Marcotte ..... B26B 19/42 30/208
2,223,310 A * 11/1940 Testi ..... B26B 19/042 30/43.2

(Continued)

FOREIGN PATENT DOCUMENTS

| | | | | |
|---|---|---|---|---|
| FR | 2964023 A1 | 3/2012 | | |
| GB | 2462812 A | 2/2010 | | |
| WO | WO 2013096572 A1 * | 6/2013 | ..... | B26B 19/3806 |

*Primary Examiner* — Sean Michalski

(74) *Attorney, Agent, or Firm* — Richard G. Eldredge

(57) ABSTRACT

Various aspects of automated grooming systems and cutting devices are disclosed. One embodiment of an automated grooming system comprises a computing device; a cutting device comprising a handle having a proximal and distal end and a cutting head positioned near the distal end of the handle; and a plurality of positioning sensors configured to send signals to the computing device relaying the position of the cutting head relative to a surface having hair extending therefrom. The computing device may be configured to receive the signals from the positioning device and prepare instructions for actuation of the cutting device. In some embodiments, the cutting device comprises a processor configured to receive the prepared instructions from the computing device and actuate the cutting device according to the prepared instructions.

20 Claims, 9 Drawing Sheets

(56) References Cited

U.S. PATENT DOCUMENTS 2,253,195 A * 8/1941 Oster ..... B26B 19/042 30/346.51
2,265,383 A * 12/1941 Martin ..... B26B 19/06 30/208
2,448,219 A * 8/1948 Hirsch ..... B26B 19/06 30/43.92
2,972,351 A * 2/1961 Morgan ..... B26B 19/00 132/213
3,054,183 A 9/1962 Zucker
3,093,901 A * 6/1963 Wahl ..... B26B 19/205 30/201
3,233,614 A * 2/1966 Lefcoski ..... B26B 19/02 132/213
3,241,562 A * 3/1966 Gronier ..... B26B 19/00 132/213
3,413,985 A * 12/1968 Dlouhy ..... A45D 44/06 132/213
3,536,079 A 10/1970 Dlouhy et al.
3,570,500 A * 3/1971 Berry ..... B26B 19/00 132/213
3,577,642 A * 5/1971 Tripoli ..... G01B 13/08 33/549
3,626,195 A * 12/1971 Fitzjohn ..... G01B 7/12 250/233
4,195,250 A * 3/1980 Yamamoto ..... G01B 7/008 318/561
4,249,062 A * 2/1981 Hozumi ..... B23K 9/12 219/124.22
4,279,594 A * 7/1981 Rigutto ..... A61B 1/253 433/31
4,433,382 A * 2/1984 Cunningham ..... G05B 19/4083 700/186
4,486,843 A * 12/1984 Spongh ..... B25J 9/1661 318/568.14
4,602,542 A * 7/1986 Natrasevschi ..... B26B 19/00 132/214
4,825,546 A * 5/1989 Araki ..... B26B 19/06 30/195
4,897,586 A * 1/1990 Nakata ..... G05B 19/42 318/568.16
4,951,394 A * 8/1990 Meijer ..... B26B 19/3846 30/223
5,153,994 A * 10/1992 Emmett ..... B26B 19/06 30/133
5,240,107 A * 8/1993 Casale ..... B26B 21/4087 206/349
5,461,780 A * 10/1995 Morana ..... B26B 21/12 30/29.5
5,579,581 A * 12/1996 Melton ..... B26B 19/063 30/223
5,791,050 A * 8/1998 Masi ..... B26B 19/38 30/296.1
5,794,348 A * 8/1998 Scott ..... B26B 21/12 30/195
5,865,192 A * 2/1999 Sealy ..... B26B 29/06 132/214
6,073,350 A * 6/2000 Elston ..... B26B 19/06 30/216
6,502,312 B2 * 1/2003 Beutel ..... B26B 19/063 30/216
6,836,700 B2 * 12/2004 Greene ..... B25J 9/1664 118/316
6,886,255 B2 * 5/2005 Freas ..... B26B 19/06 30/200
6,952,168 B2 * 10/2005 Recko, Jr. ..... G08B 3/10 340/331
6,973,931 B1 12/2005 King
7,298,535 B2 * 11/2007 Kuutti ..... G08B 21/182 359/13
7,415,767 B2 * 8/2008 Saker ..... B26B 21/38 30/34.05
8,104,178 B2 * 1/2012 Worgull ..... B26B 19/06 30/208
8,180,479 B2 * 5/2012 Xu ..... B26D 5/20 700/160
8,446,247 B2 * 5/2013 Allen ..... F16P 3/14 340/3.1
8,474,466 B2 * 7/2013 Lakin ..... B26B 19/00 132/213
8,571,722 B2 * 10/2013 Samples ..... G08G 1/168 701/1
8,651,160 B2 * 2/2014 Urabe ..... B25J 9/1682 156/250
8,723,912 B2 * 5/2014 Michrowski ..... H04N 7/147 348/14.01
8,818,548 B2 * 8/2014 Aoki ..... A01D 34/828 340/680
8,928,747 B2 * 1/2015 Burdoucci ..... A45D 44/005 348/61
9,084,891 B2 * 7/2015 Aberizk ..... B26B 19/42
9,174,351 B2 * 11/2015 Binder ..... B26B 19/42
2002/0119428 A1 * 8/2002 Vitale ..... A45D 24/36 434/94
2004/0004559 A1 1/2004 Rast
2005/0244057 A1 * 11/2005 Ikeda ..... A45D 44/005 382/181
2005/0273109 A1 * 12/2005 Bjork ..... A61B 17/1626 606/80
2007/0220754 A1 * 9/2007 Barbaro ..... A45D 27/22 30/41
2008/0175448 A1 * 7/2008 Fujiwara ..... G06K 9/00208 382/118
2009/0303320 A1 * 12/2009 Davis ..... H04N 7/181 348/77
2010/0026717 A1 * 2/2010 Sato ..... A45D 44/005 345/642
2010/0122614 A1 * 5/2010 Waterman ..... B08B 9/0808 83/360
2010/0186234 A1 * 7/2010 Binder ..... A45D 26/00 30/34.05
2011/0018985 A1 * 1/2011 Zhu ..... A45D 44/00 348/61
2011/0225830 A1 * 9/2011 Moseman ..... B26B 19/3846 30/225
2014/0182138 A1 * 7/2014 Krenik ..... B26B 19/3806 30/123

* cited by examiner

HAIR CUTTING TECHNIQUES FOR AUTOMATED HAIR CUTTING SYSTEM

CROSS REFERENCE TO RELATED APPLICATIONS

This application claims priority to U.S. Provisional Application Ser. No. 61/901,093, filed by Matthew W. Krenik on Nov. 7, 2013, entitled "Positioning Methods for Automated Hair Cutting System"; and U.S. Provisional Application Ser. No. 61/925,567, filed on Jan. 9, 2014, entitled "Hair Cutting Techniques for Automated Hair Cutting System"; and is a continuation-in-part application of U.S. patent application Ser. No. 14/086,497 filed by Matthew W. Krenik on Nov. 21, 2013, entitled "Sensing and Control Techniques for Automated Hair Cutting System," which claims priority to U.S. Provisional Application Ser. No. 61/728,851, filed by Matthew W. Krenik on Nov. 21, 2012, entitled "Cutter Head Sensing and Control for Automated Hair Cutting System;" and U.S. Provisional Application Ser. No. 61/780,086, filed by Matthew W. Krenik on Mar. 13, 2013, entitled "Techniques for Automated Hair Cutting System," all of which are commonly owned with this application and the contents all are incorporated herein by reference.

TECHNICAL FIELD

The present disclosure relates generally to grooming systems and methods, and more specifically, to a cutter head and improvements thereof used in conjunction with an automated system, such as an automated hair cutting system.

BACKGROUND

International application number PCT/US12/70856, filed by Matthew W. Krenik on Dec. 20, 2012, entitled "Automated Hair Cutting System and Method of Operation Thereof," (hereinafter "Krenik '856") provides a description of some embodiments of automated hair cutting systems. These systems operate by determining the position and/or orientation of a hair cutting device relative to a user receiving a haircut. Hair may be collected in a cutter head and extended for cutting to a desired length. Through electronic measurements and computational analysis, the location of where hair on the scalp of a user is collected into a cutter head may be determined and as hair is extended and slides through a cutter head, its length may be substantially determined so that a cutter head may be actuated at a certain time to cut hair.

Krenik '856 identifies multiple ways that an automated hair cutting system may be used to cut hair, including how automated hair cutting systems may be applied to cut hair so that a wider range of styles, more accurate or otherwise desirable results, or other benefits may be achieved in providing a user with a desirable haircut.

U.S. patent application Ser. No. 14/051,201 filed by Matthew W. Krenik on Oct. 10, 2013, entitled "Cutter Head for Automated Hair Cutting System," (hereinafter "Krenik '201") provides embodiments of cutter heads suitable for use with automated hair cutting systems. The embodiments of hair cutting devices shown in the present disclosure may use the cutter heads shown in Krenik '201, the cutter heads described in the present disclosure, or other suitable cutter heads. U.S. patent application Ser. No. 14/086,497 filed by Matthew W. Krenik on Nov. 21, 2013, entitled "Sensing and Control Techniques for Automated Hair Cutting System," (hereinafter "Krenik '497") provides embodiments of sensing, actuation, and control systems for cutter heads for automated hair cutting systems. The embodiments of automated hair cutting systems shown in the present disclosure may utilize the sensing, actuation, and control systems shown in Krenik '497, those described in the present disclosure, or other suitable sensing, actuation, and control systems. U.S. patent application Ser. No. 14/156,817 filed by Matthew W. Krenik on Jan. 16, 2014, entitled "Positioning Device for Automated Hair Cutting System," (hereinafter "Krenik '817") provides embodiments of positioning devices for automated hair cutting systems. The embodiments of positioning devices shown in the present disclosure may utilize the positioning devices shown in Krenik '817, those described in the present disclosure, or other suitable positioning devices.

SUMMARY

Disclosed herein are various aspects of cutting devices for use with automated hair cutting systems. In one embodiment, the cutting device may comprise a handle having a proximal and distal end; a cutting head positioned near the distal end of the handle. The cutting head may comprise a cutting instrument, said cutting instrument having a plurality of cutter knives, said cutter knives configured having a sharp angled edge on at least one side thereof; and a comb coupled proximate the cutting instrument, said comb having a first and second end and a plurality of teeth positioned therebetween, wherein the plurality of teeth and at least one of the first and second end have a sharp angled edge on an inner side thereof; wherein the sharp angled edges of the cutter knives are configured to engage the sharp angled edges of the plurality of teeth when the cutting instrument is actuated. The cutting device may also comprise at least one positioning sensor configured to interact with the automated hair cutting system, said interaction comprising at least one signal indicating the position of the cutting head relative to a surface having hair extending therefrom.

In another embodiment, there may be disclosed an automated grooming system, comprising a computing device; and a cutting device. The cutting device comprises a handle having a proximal and distal end; a cutting head positioned near the distal end of the handle, the cutting head comprising a cutting instrument, said cutting instrument having a plurality of cutter knives, said cutter knives configured having a sharp angled edge on at least one side thereof; and a comb coupled proximate the cutting instrument, said comb having a first and second end and a plurality of teeth positioned therebetween, wherein the plurality of teeth and at least one of the first and second end have a sharp angled edge on one side thereof; and wherein the sharp angled edges of the cutter knives are configured to engage the sharp angled edges of the plurality of teeth when the cutting instrument is actuated. The automated grooming system may also comprise at least one positioning sensor configured to interact with the computing device, the interaction including at least one signal indicating the position of the cutting head relative to a surface having hair extending therefrom.

In yet another embodiment, there may be an automated grooming system, comprising a computing device; a cutting device comprising a handle having a proximal and distal end and a cutting head positioned near the distal end of the handle; and a plurality of positioning sensors configured to send signals to the computing device relaying the position of the cutting head relative to a surface having hair extending therefrom. The computing device may be configured to receive the signals from the positioning device and prepare instructions for actuation of the cutting device.

DETAILED DESCRIPTION

Figure 1:
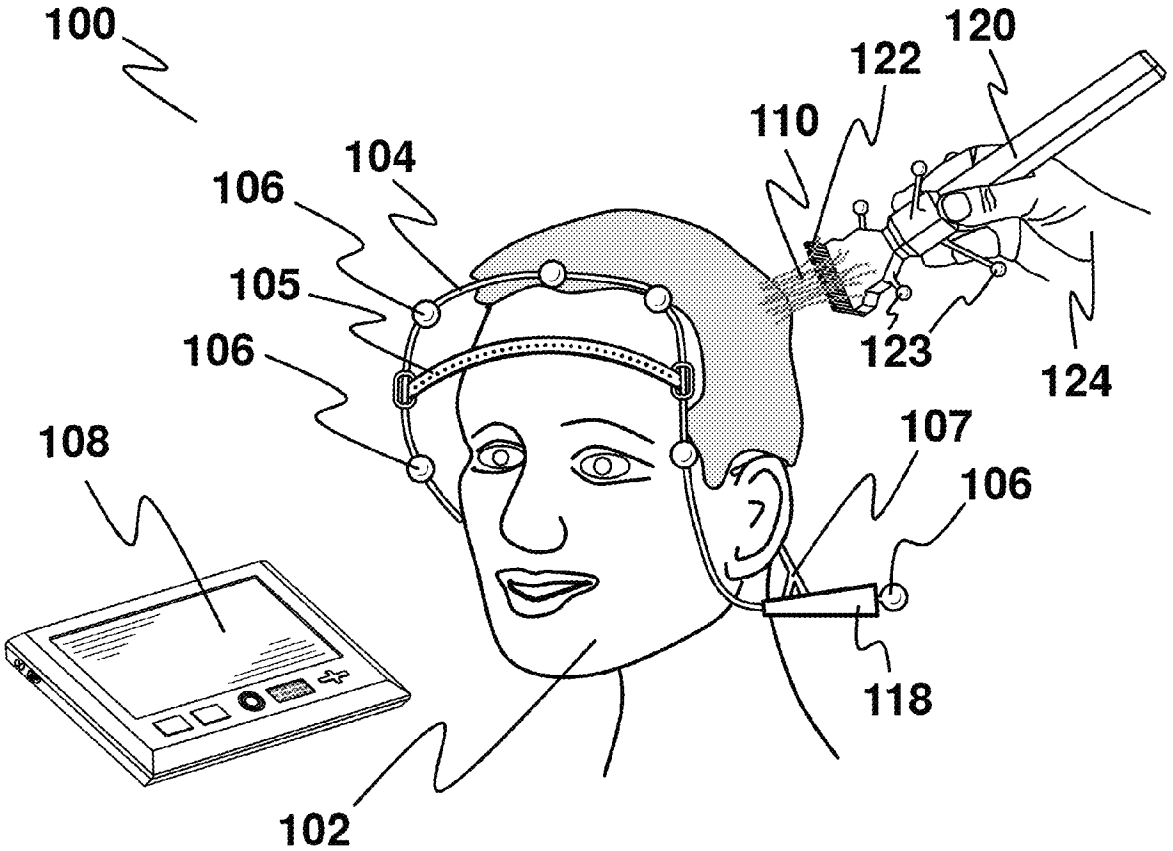
FIG. 1 is an environmental view of one embodiment of an automated hair cutting system.

Automated hair cutting systems provide a wide range of flexibility for how hair may be collected in a cutter head, extended to a desired length, and cut. The present disclosure provides enhanced systems, techniques, and methods for how automated hair cutting systems may be enhanced and applied in additional ways to achieve results, including improved ways in which a user and an automated hair cutting system may interact. A cutter head of a hair cutting device may be tilted so that the cutter head tips slide over a user's scalp while the cutter head is actuated so that a closer shaving action than may otherwise be possible is achieved. A user may be guided to orient a hair cutting device so that hair collected near the base region of a cutter head (near where the cutter knives and comb teeth first meet when the cutter head is actuated to cut hair) may be cut first and hair near the tips of the cutter head may be cut later, so that hair is cut accurately as the hair cutting device is manipulated to extend hair for cutting. In this way, hair collected in a cutter head may be cut to different lengths as actuation of a cutter head may be coordinated with extension of hair through the cutter head so that hair is substantially optimally cut to its desired length. Further, hair may be cut to conform to various gradients and contours of hair lengths associated with various regions of a user's scalp, according to a desired hair style. The tips of a cutter head may also be inserted into hair, possibly along a part that has been combed into the hair, so that thinning, feathering, or layering effects may be produced.

Operation of an automated hair cutting system may involve a user interacting with an electronic computing device, a positioning device, a hair cutting device, and possibly with other elements that may be present in some embodiments of automated hair cutting systems. Users of automated hair cutting systems may prefer to observe themselves in a mirror as they are cutting their hair. Hence, especially for the case of a user operating an automated hair cutting system to give themselves a haircut, it is important that the user be able to operate the automated hair cutting system in a simple and intuitive way. The present disclosure teaches techniques for how an automated hair cutting system may guide a user with audible sound, visual, haptic, and/or other signals for how to manipulate a hair cutting device. Coordinate axes that extend, e.g., vertically and horizontally through a user's head, and signals may direct a user to orient a hair cutting device relative to these axes during a haircut. Visual images on the screen of an electronic computing device may be provided in conjunction with audible sound signals, haptic signals, and other possible signals so that a user may respond to visual signals, sound signals, touch signals, indicator lights, other signals, or combinations of signals.

Hair cutting devices may include buttons, knobs, switches, touch sensitive areas, or other interfaces that may allow a user to send signals to an automated hair cutting system. Hair cutting devices may also include physical features, guides, shape, or other elements that a user may touch, and in touching them, may determine an orientation of the hair cutting device, so that the user may more easily manipulate the hair cutting device without needing visual confirmation.

Referring now to FIG. 1, there is shown an embodiment of an automated hair cutting system 100 cutting a region of hair 110 on a user 102. Automated hair cutting system 100 comprises a hair cutting device 120 including a cutter head 122, an electronic computing device 108, and a positioning device 104 having a plurality of positioning interfaces 106. Hair cutting device 120, electronic computing device 108, and positioning device 104 may communicate and interact over wired or wireless electronic interfaces. Computing device 108 may include a user interface for receiving inputs from an operator.

Positioning signals may be generated and propagate between positioning interfaces 106 on positioning device 104 and sensors 123 on hair cutting device 120. Positioning device 104 may be supported on the head of user 102 with ear supports 107 and head band 105. Housings 118 may contain batteries, electronics, or other elements. Positioning device 104 utilizes a tubular construction, but those skilled in the art will recognize that many alternative structures and constructions for positioning devices may be used.

Analysis of these positioning signals may allow automated hair cutting system 100 to determine the position and/or orientation of hair cutting device 120 relative to the head of user 102. Embodiments of automated hair cutting system 100 are described in more detail in Krenik '856. Hair cutting system 100 may operate through observation of and/or interaction with user 102 and/or positioning device 104 by hair cutting device 120 and/or other system elements to substantially allow the position and/or orientation of hair cutting device 120 to be determined relative to the head of user 102 so that selected regions of hair 110 may be collected in a cutter head 122 of hair cutting device 120, extended to a desired length, and cut. Additional embodiments, modes of operation and additional description of automated hair cutting system 100 may be found in Krenik '856.

Some embodiments of automated hair cutting system 100 may not use a positioning device and the position and/or orientation of hair cutting device 120 relative to the head of user 102 may be determined through use of some combination of cameras, motion sensors, accelerometers, gyroscopes, and/or other sensors. Some embodiments of automated hair cutting system 100 may combine a positioning device 104 with a combination of cameras, motion sensors, accelerometers, gyroscopes, and/or other sensors for determination of the position and/or orientation of a hair cutting device 120 relative to the head of a user 102.

Hair cutting device 120 is shown supported by hand 124 of an operator. The operator may be either user 102, or another person giving user 102 a haircut. The operator may respond to instructions, queues, or additional guidance or information from electronic computing device 108 or other elements of automated hair cutting system 100 during a haircut. The instructions, queues, or additional guidance or information may be presented visually on a display of electronic computing device 108 or other electronic displays, and may include audible sound signals, indicator lights, haptic signals, or other possible signals. Hair cutting device 120 may also provide haptic signals to hand 124 in the form of vibrations, jarring, bumping, or jogging signals, or other forms of haptic signals. Some embodiments of automated hair cutting system 100 may include additional elements or additional features that attach to user 102, are held by user 102, interact with user 102, provide guidance to user 102, monitor user 102, take images or video of user 102, or otherwise function to observe, monitor, sense, signal, or guide user 102. For example, a haptic device such as a vibrating watch band may be worn by user 102 on one of their wrists. Another example would be a positioning device 104 including an electronic display used to provide guidance or instructions to user 102.

Electronic computing device 108 and other system elements of automated hair cutting system 100 may be connected with the internet, a wireless communication network, other computers, printers, information systems, or other systems. Automated hair cutting system 100 may collect and store information about user 102 including their age, sex, hair style, hair color, hair type, personal preferences, and other information and recommend hair care and other products for user 102 to purchase. In some embodiments, electronic computing device 108 may be configured such that user 102 can purchase one or more recommended products through an interface therethrough.

Certain embodiments may use positioning signals between the positioning interfaces 106 on positioning device 104 and sensors 123 on hair cutting device 120. These signals may propagate from any of the positioning interfaces 106 to any of the sensors 123 on hair cutting device 120 and may comprise electromagnetic signals, sound signals, light signals, magnetic signals, acoustic signals, ultrasonic signals, infrared light signals, radar signals, sonar signals, lidar signals, or other types of signals. Some embodiments may be configured such that positioning signals propagate from a hair cutting device 120 to a positioning device 104, or propagate in both directions. Positioning signals may be modulated to provide timing information or other information and may make use of FSK (Frequency Shift Keying), PSK (Phase Shift Keying), ASK (Amplitude Shift Keying), or other forms of signal modulation. Positioning signals may be processed using signal processing techniques including filtering, correlation, slicing, amplification, gain control, signal power level control, frequency detection, amplitude detection, phase detection, averaging, analog-to-digital conversion, decimation, interpolation, and/or other suitable signal processing techniques. Positioning signals from positioning interfaces 106 to sensors 123 may also be coordinated so that they do not interfere with each other, or only interfere in pre-defined ways that allow system operation. Those skilled in the art will recognize that positioning signals may be coordinated with TDMA (Time Division Multiple Access), FDMA (Frequency Division Multiple Access), CDMA (Code Division Multiple Access), or other suitable schemes for coordinating signals. Analysis of these positioning signals may be used in computation of the position and/or orientation of hair cutting device 120 relative to user 102. Some embodiments may also comprise one or more cameras on hair cutting device 120, positioning device 104, electronic computing device 108, or other system elements for collecting images or video of positioning device 104, user 102, or hair cutting device 120, for analysis and use in computation of the position and/or orientation of hair cutting device 120 relative to user 102. In Krenik '856, additional explanation is provided for a wide range of signal types, signal coding, signal modulation, signal coordination, and types of sensors or transducers that may be used to generate and/or sense these positioning signals, and many other aspects for various embodiments of signals, interfaces, cameras, sensors and other elements or signals for automated hair cutting system 100.

Most hair cutting operations using automated hair cutting system 100 are intended for a user or operator to cut hair in a simple and effective manner. For example, a user 102 may start the automated hair cutting system 100 by switching on electronic computing device 108 and selecting a hair style. User 102 may then put on positioning device 104 and perform a calibration sequence to calibrate positioning device 104 to their head. In some embodiments, user 102 may use hair cutting device 120 to measure the length of their hair so that automated hair cutting system 100 can verify their hair is long enough for a given hair style (see Krenik '201 and Krenik '497 for more information on how hair length may be measured with a hair cutting device). With this completed, user 102 may simply begin collecting hair into cutter head 122 of hair cutting device 120 and extending hair for cutting. While user 102 is working, automated hair cutting system 100 may keep track of where hair may be left uncut and where errors in the orientation or position of hair cutting device 120 caused some hair to be cut too long. Automated hair cutting device 100 may also ensure that hair is never cut too short through analysis of the position and orientation of hair cutting device 120 and control of cutter head 122. Clearly, if hair is cut somewhat too long due to how user 102 is manipulating hair cutting device 120, due to rapid changes in the desired length of hair for a given style, or other reasons, hair may be cut again with a repeated cycle of collection, extension, and cutting of hair. And while user 102 is working to cut their hair, automated hair cutting system 100 may provide visual, audible, haptic, or other signals to user 102 to improve how they are manipulating hair cutting device 120. Such guidance may be specific or may be more general. General advice, for example, may be suggestions such as "try to hold the handle a bit higher as you extend hair", "it may work better to collect hair on the side of your head with an upward combing motion", "move the cutting device a bit more slowly", and other possible suggestions. As user 102 completes working over their scalp and is completing a haircut, automated hair cutting system 100 may call user's 102 attention to areas of their scalp that may have been missed (i.e. where hair was left uncut) or where hair was cut too long due to errors in manipulating hair cutting device 120 (or due to limitations due to the size of cutter head 122 in areas where desired hair length changes rapidly, or due to other reasons). User 102 may decide to attend to these issues, or may decide that their hair looks good enough. For many users and for many hair styles, hair does not need to be cut to very high accuracy. Hence, many users may be happy enough with a haircut that includes small inaccuracies, but still looks acceptable. Some embodiments of automated hair cutting system 100 may include haircut tolerance controls that allow a user 102 to control an accuracy tolerance to which hair may be cut and to ignore errors below a tolerance setting (in some embodiments, such accuracy tolerances may also be established automatically). Such tolerance controls may be accessed through electronic computing device 108 or possibly through other system elements that may be present in some embodiments.

Figure 2:
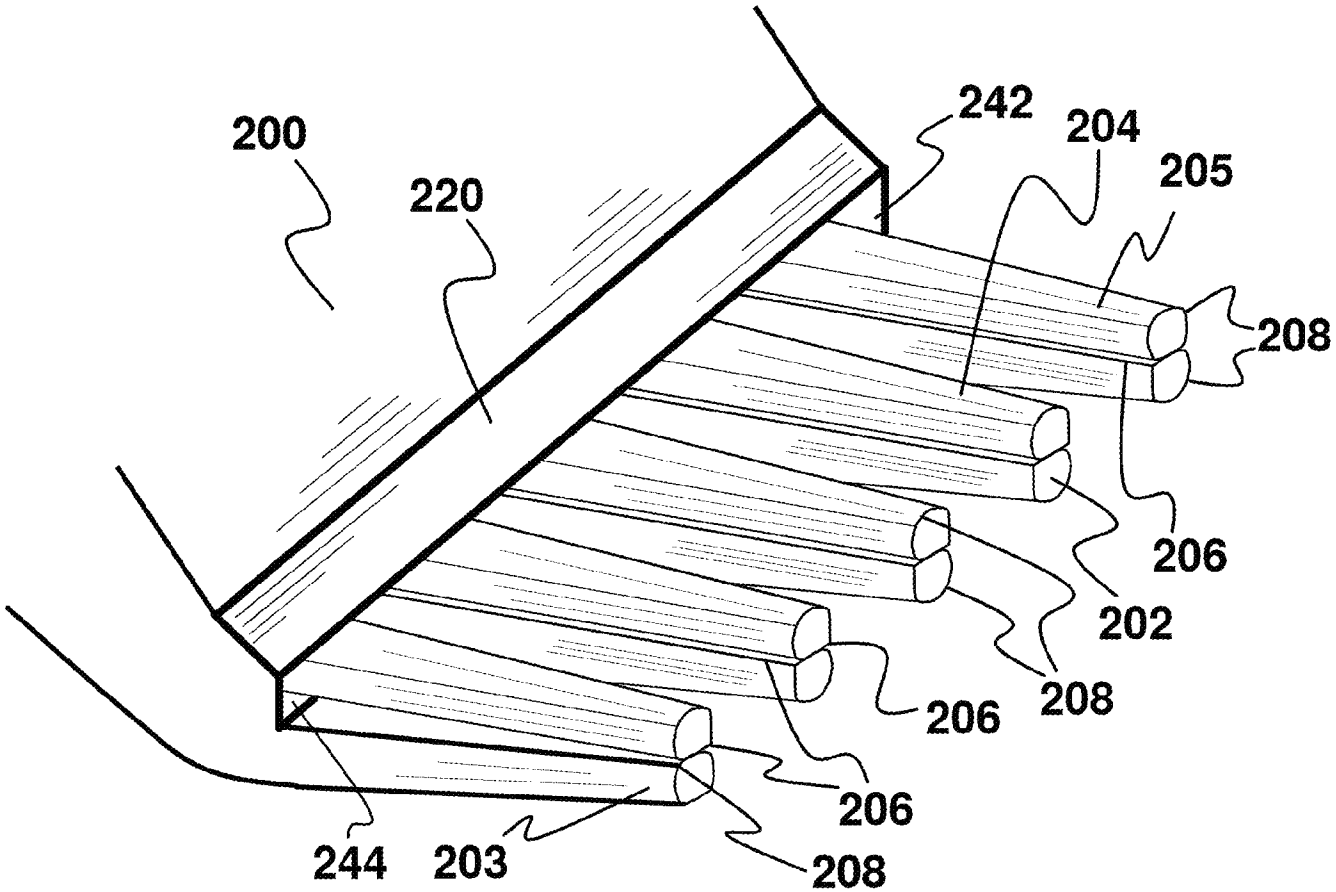
FIG. 2 is a perspective view of one embodiment of a cutter head according to the present disclosure.

Referring now to FIG. 2, there is shown an embodiment of a cutter head 200 for use in hair cutting devices that allows hair to be collected, allows actuation of the cutter knives 204 in a first direction to apply pressure and friction to hair so that it may manipulated, extended, and cut, and may also enable cutting action when the cutter knives 204 are actuated in a second direction. Cutter head 200 comprises cutter knives 204, comb teeth 202, and body 220. Cutter head 200 may be actuated in a variety of ways, including wherein cutter knives 204 are substantially above comb teeth 202 so that hair may be collected in cutter head 200. Another actuation enables cutter knives 204 to move to the left (toward the lower left corner of FIG. 2) so that rounded edges 208 of cutter knives 204 and comb teeth 202 apply pressure to hair collected in cutter head 200. Applying pressure to hair collected into cutter head 200 creates friction which enables manipulation of hair collected in cutter head 200 with less possibility of the collected hair failing out of the cutter head 204. Yet another actuation includes cutter knives 204 moving to the right (toward the upper right corner of FIG. 2) so that sharp edges 206 of cutter knives 204 and comb teeth 202 meet and pass over each other to provide a cutting action. Left most comb tooth 203 and right most cutter knife 205 have only rounded edges 208 and have no sharp edges 206 as left most comb tooth 203 and right most cutter knife 205 are not used for cutting hair during a cutting stroke. Gap 242 and gap 244 provide spacing between cutter knives 204 and body 220 so that they may move to the right and left. Cutter head 200 may be fabricated from metals, ceramics, glass, sapphire, and other suitable materials.

In some embodiments, cutter knives 204 may be independently actuated so that hair collected between adjacent cutter knives 204 may be cut to different lengths; while in other embodiments cutter knives 204 may be actuated all together at the same time, or actuated in groups. Krenik '201 provides additional description of cutter heads similar to cutter head 200 and also describes additional embodiments of cutter heads suitable for some embodiments of hair cutting devices. While some embodiments may include teeth pointed in different directions, the examples provided in the present disclosure are similar to the teeth of cutter head 200, which emanate in the direction away from the side of body 220 visible in FIG. 2, are pointed away from body 220, and are pointed substantially toward the lower right side of FIG. 2 in the view shown.

Figure 3:
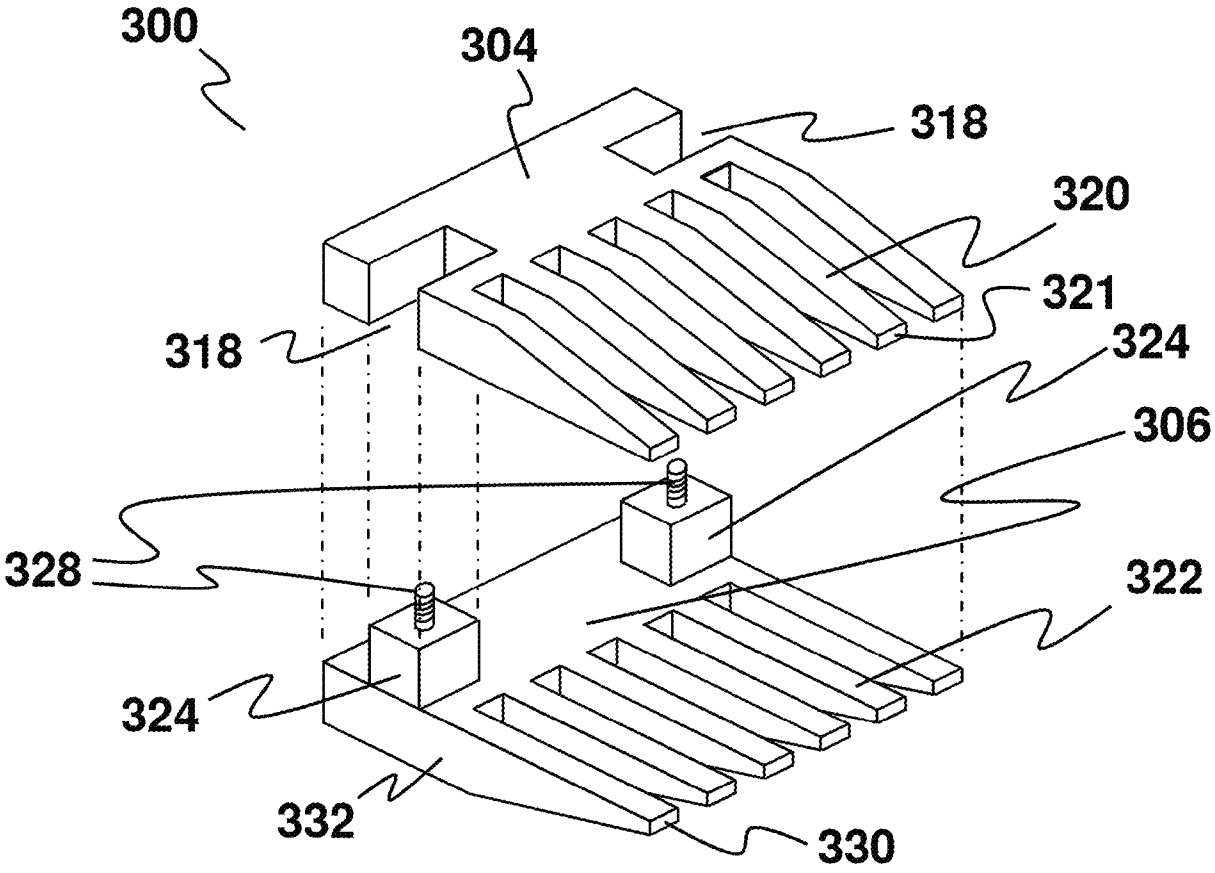
FIG. 3 is an exploded view of another embodiment of a cutter head according to the present disclosure.

Referring now to FIG. 3, there is shown an exploded view of a cutter head 300 that may be used in some embodiments of hair cutting devices. Cutter head 300 comprises a bottom comb 306 and a top cutter 304. Bottom comb 306 comprises comb teeth 322 and tips 330, and includes mounting standoffs 324 with mounting screws 328 for fastening the bottom comb 306 to a cutting device such as hair cutting device 120. Top cutter 304 includes cutter knives 320, and guide openings 318. The mounting screws 328 may affix bottom comb 306 to a base of hair cutting device 120 and mounting standoffs 324 may engage guide openings 318 for maintaining a lateral force on top cutter 304 for guiding actuation of top cutter 304 relative to bottom comb 306. The lateral force may come from a motor or actuator acting through a combination of levers, gears, hubs, or other elements. Other embodiments may use a wide range of couplings such as screws, welds, hubs, slots, or other couplings applied to couple motion from an actuator, motor, or associated levers, hubs, axles, or other mechanisms to top cutter 304.

Cutter head 300 may be used in multiple ways to collect, extend, and/or cut hair during operation of automated hair cutting system 100. For example, hair may be collected and extended through cutter head 300 when cutter knives 320 are substantially aligned on top of comb teeth 322 and hair collected in cutter head 300 may be cut when top cutter 304 is actuated so that the sharp edges of cutter knives 320 and comb teeth 322 meet and pass over each other. Cutter knives 320 and comb teeth 322 may be constructed similar to cutter knives 204 and comb teeth 202 of cutter head 200 or may be of other construction (see Krenik '201 for additional possible embodiments of cutter knives and comb teeth). It is noted, in particular, that the cutting edges of cutter knives 320 and comb teeth 322 as shown in FIG. 3 are substantially parallel. In the present disclosure, the benefits of cutter heads comprising cutter knives and comb teeth with slanted sharp edges will be subsequently described.

Base 332 of bottom comb 306 has a first thickness T1. In some embodiments, tips 330 will have a second thickness T2, smaller than the first thickness T1 of base 332. Similarly, top cutter 304 and cutter knives 320 have a third thickness T3, and top tips 321 have a fourth thickness T4, which may likewise be smaller than third thickness T3. The smaller thickness T2 and T4 of tips 330 and top tips 321 relative to the thickness T1 and T3 of base 332 and cutter knives 320 enables cutter head 300 to pass through and separate hair with less resistance, similar to teeth of traditional hair combs.

Figure 4:
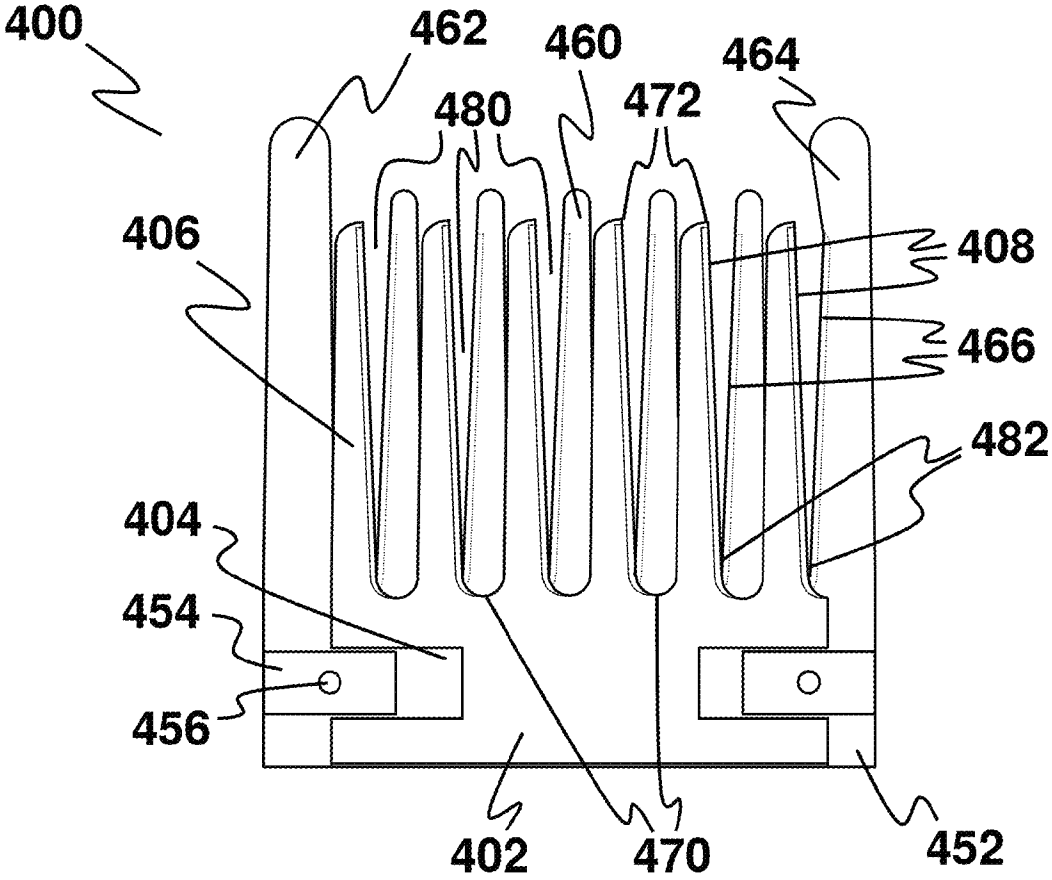
FIG. 4 is a top view of another embodiment of a cutter head according to the present disclosure.

In FIG. 4 there is shown a top view of another embodiment of a cutter head, cutter head 400. Cutter head 400 comprises top cutter 402 and bottom comb 452. Top cutter 402 comprises cutter knives 406 having slanted sharp edges 408. Bottom comb 452 comprises left end comb tooth 462, comb teeth 460, and right end comb tooth 464. Comb teeth 460 and right end comb tooth 464 have slanted sharp edges 466. Bottom comb 452 comprises mounting standoffs 454 each having a hole 456 that may be used with a mounting screw. Top cutter 402 comprises guide openings 404 that mate with mounting standoffs 454 to provided guided motion of top cutter 402 relative to bottom comb 452. Top cutter 402 may be driven by an actuator, motor, or other driver or mechanism. A driver, motor, actuator, or mechanism may be coupled to top cutter 402 by a wide range of couplings such as screws, welds, hubs, slots, or other couplings.

Cutter head 400 is similar in assembly and operation to cutter head 200 and cutter head 300 but with cutter knives and comb teeth having different shapes and constructions. Cutter head 400 includes slanted (top) sharp edges 408 and slanted (bottom) sharp edges 466 that meet and pass over each other to cut hair during a cutting stroke of cutter head 400 (similar to blades on a traditional pair of scissors). Openings 480 form between slanted sharp edges 408 and slanted sharp edges 466, and hair may be collected in openings 480 when top cutter 402 is actuated to the left relative to bottom comb 452 (that is, top cutter 402 may be actuated toward the left side of FIG. 4 so that openings 480 are opened further). A cutting stroke of cutter head 400 occurs as top cutter 402 is actuated to the right (that is, toward the right side of FIG. 4) so that slanted sharp edges 408 and slanted sharp edges 466 meet and pass over each other, causing openings 480 to close and cut hair collected in them. As slanted sharp edges 408 and slanted sharp edges 466 meet and pass over each other, a cutting point 482 is formed in each opening 480 at the point where slanted sharp edges 408 and slanted sharp edges 466 meet. Cutting points 482 form first when slanted sharp edges 408 and slanted sharp edges 466 meet near base 470 during a cutting stroke of cutter head 400 and cutting points 482 move upwards (toward the top of FIG. 4) as a cutting stroke of cutter head 400 progresses. During a cutting stroke, hair collected in openings 480 nearest the base 470 of cutter knives 406 is cut first and hair collected in openings 480 nearest the tips 472 of cutter knives 406 is cut last. The sides of cutter knives 406 opposite slanted sharp edges 408, the sides of comb teeth 460 opposite slanted sharp edges 466, and the right side of left end comb tooth 462 may be used to apply pressure and friction to hair collected in cutter head 400 (similar to description related to cutter head 200). Krenik '201 provides additional embodiments and descriptions of cutter heads similar to cutter head 400 and other possible cutter heads.

Figure 6:
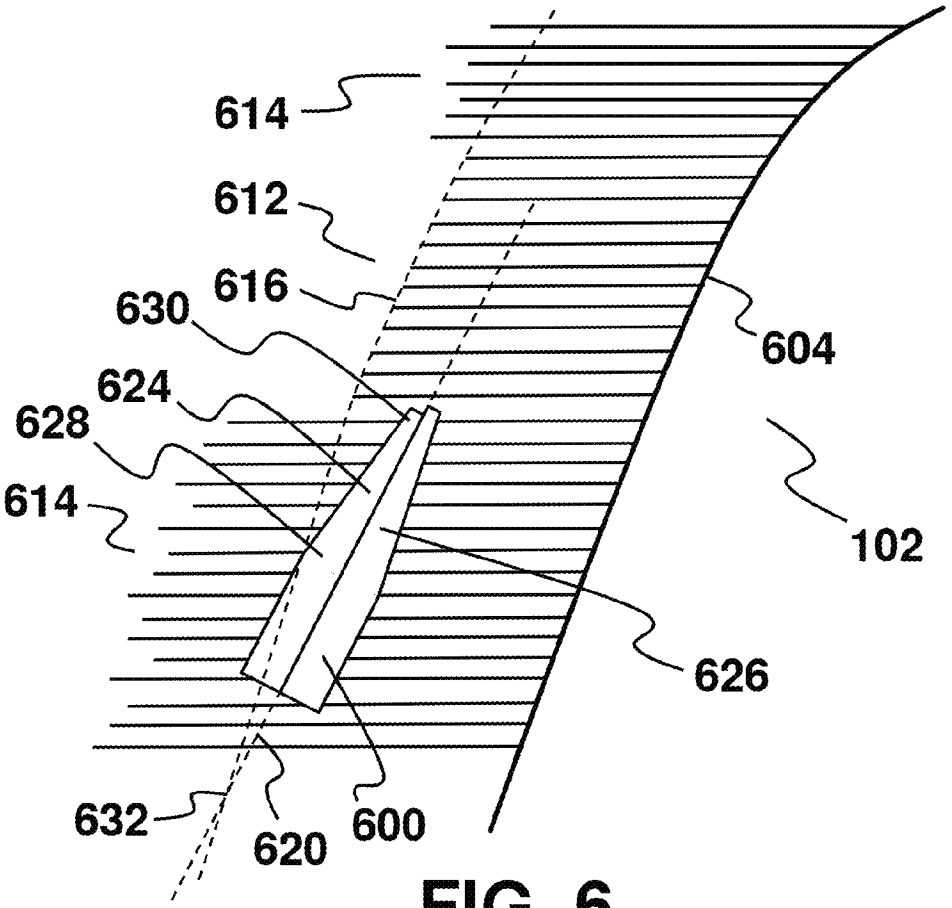
FIG. 6 is another environmental view of a timed hair cutting operation using a cutter head according to the present disclosure.
Figure 7:
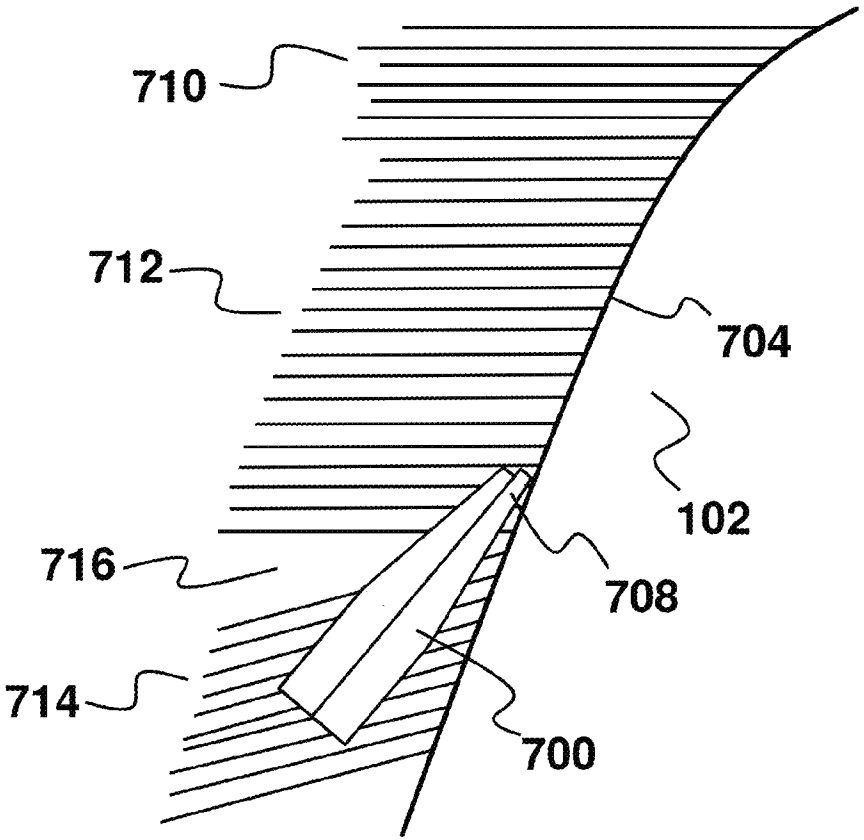
FIG. 7 is yet another environmental view of a hair cutting operation using one embodiment of a cutter head according to the present disclosure.

FIGS. 6 and 7 illustrate embodiments and methods related to control and utilization of slanted sharp edges of cutter knives and comb teeth that may meet and cut hair at different times during a cutting stroke. While cutter head 400 comprises slanted cutting edges for both slanted sharp edges 408 on cutter knives 406 and slanted sharp edges 466 on comb teeth 460 and right end comb tooth 464, those skilled in the art will recognize that embodiments with a combination of parallel and slanted sharp edges are possible. For example, if slanted sharp edges 466 on comb teeth 460 and right end comb tooth 464 are replaced with sharp edges that are substantially parallel to the outer edges of left end comb tooth 462 and right end comb tooth 464, the presence of slanted sharp edges 408 on cutter knives 406 still enable hair to be collected and cut accordingly. Similarly, some embodiments may comprise parallel sharp edges on cutter knives and slanted sharp edges on comb teeth. Those skilled in the art will recognize that in addition to cutting edges that are substantially straight and slanted, some embodiments of cutter heads may utilize cutting edges that incorporate various curved edges, such as convex edges, concave edges, a combination of curves, a combination of curved and straight edges, or other shapes. Cutter heads with curved cutting edges may also be applied. Many embodiments of cutter heads incorporating cutter knives with slanted edges at various angles, curved edges, parallel edges, serrated edges, wavy edges, combinations of different shapes of edges, and other suitable shapes or types of edges are possible.

Figure 5:
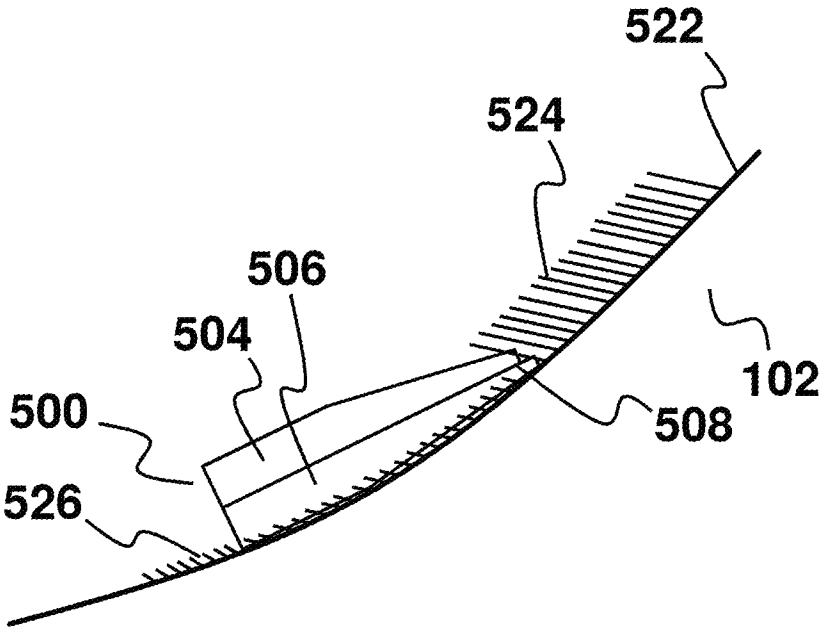
FIG. 5 is an environmental view of a hair cutting operation using a cutter head according to the present disclosure.

Referring now to FIG. 5, there is shown a side view of a cutter head 500 trimming long hair 524 to create short hair 526 on the back of a neck 522. Cutter head 500 comprises top cutter 504 and bottom comb 506. Cutter head 500 may be of similar construction to cutter head 200, cutter head 300, cutter head 400, or other possible embodiments of cutter heads. Cutter head 500 has comb teeth that are thinner near the tips 508 of the comb teeth of bottom comb 506, similar to cutter head 300. Cutter head 500 is shown engaging long hair 524 near the tips 508 of top cutter 504 and bottom comb 506 so that long hair 524 may be cut to a shortest possible length. In some hair styles, hair may be cut as short as possible on some regions of the scalp. For example, many common men's hair styles involve shaving or trimming the back of the neck so that hair on the back of a man's neck but below a scalp line is neatly kept very short. And some modern hair styles include shaved hair or hair cut rather short on some regions of the scalp. Using cutter head 500 to cut hair at the tips 508 of the cutter knives and comb teeth, where the comb teeth are the thinnest, allows hair to be cut to a substantially short length on desired regions of a user's 102 scalp, including on neck 522. Cutter head 500 may be actuated continuously so that hair is cut as it enters cutter head 500.

Automated hair cutting system 100 may use the position and/or orientation of a hair cutting device to which cutter head 500 is attached to control actuation of cutter head 500 to achieve various hair lengths. For example, when cutter head 500 is positioned near the back of neck 522, automated hair cutting system 100 may actuate cutter head 500 in a continuous fashion to cut hair short. As cutter head 500 moves upwards away from the back of neck 522, actuation may continue to cut long hair 524 to produce short hair 526. As tip 508 of cutter head 500 reaches the point where longer hair is desired, actuation of cutter head 500 may be stopped or paused in order to prevent hair from being cut short than desired for a certain region on user's 102 head. In some areas of neck 522, longer hair may be desired than the length of short hair 526, so hair is collected in cutter head 500, extended away from neck 522, and cut to a desired length. As the operator moves cutter head 500 upward over the back of their neck, automated hair cutting system 100 may also provide guidance to user 102 on how best to orient cutter head 500 and possibly also how best to orient their head and neck. Such guidance may be provided visually on the display screen of electronic computing device 108, may include audible instructions produced by a speaker in electronic computing device 108, may be signaled to user 102 through haptic signals delivered through hair cutting device 120 that cutter head 500 is attached to, may be provided to user 102 through indicator lights on a hair cutting device 120, or may be provided in other possible ways or combinations of ways from the various elements possible for various embodiments of automated hair cutting system 100. Guidance may include instructions to begin moving cutter head 500 forward, stop moving cutter head 500 forward, slow the rate of movement of cutter head 500, turn cutter head 500 clockwise or counter-clockwise so that the tip 508 of cutter head 500 meets the points along which cutting action will be stopped (for a more accurate interface between where longer hair will meet short hair for a given hair style), rock hair cutting device 120 forwards or backwards so that the tip 508 of cutter head 500 engages hair and slides along neck 522, bending the neck of user 102 to beneficially align skin and hair to the position and/or motion of cutter head 500, or other possible signals and guidance that may help user 102 achieve results.

Bottom comb 506 of cutter head may be able to better cut hair to a substantially short length with comb teeth that are thinner near their tips. The cutting edges of top cutter 504 and bottom comb 506 may be slanted similarly to the slanted sharp edges 408 and slanted sharp edges 466 as shown on cutter head 400 in FIG. 4. Cutter head 300 as shown in FIG. 3 with cutting edges that are substantially parallel may also be used to cut hair to substantially short lengths as shown in FIG. 5. Operation of cutting hair to a substantially short length as shown in FIG. 5 may be achieved with a wide range of cutter heads with various combinations of slanted, curved, parallel, contoured, or otherwise shaped cutting edges.

FIG. 6 illustrates one embodiment of a cutter head 600 and a method for cutting hair wherein actuation of a cutting stroke of cutter head 600 is coordinated in time with extension of hair through the cutter head 600 as a hair cutting device is lifted away from scalp 604. (FIG. 6 illustrates the scalp 604 from a side view.) Scalp 604 is shown along with long hair 614, cut hair 612, desired hair length guide line 616, cutter head 600, and cutter head cutting interface guide line 620. Long hair 614 (that may not yet be cut to a desired length), and cut hair 612 is shown extending horizontally to the left from scalp 604, but may be cut in various other orientations. Hair may be cut through movement of cutter head 600 to extend hair along with coordinated control of the actuation of cutter head 600 to cut hair. Cutter head 600 may be of similar construction and may comprise similar features to cutter heads 200 and 400. Cutter head 600 includes slanted cutting edges, similar to slanted sharp edges 408 of cutter knives 406 and slanted sharp edges 466 of comb teeth 460 and right end comb tooth 464 as were shown for cutter head 400. That is, as the cutter knives 624 and comb teeth 626 of cutter head 600 meet and pass over each other during a cutting stroke, hair near the base 628 of cutter knives 624 will be cut in the earlier part of the cutting stroke and hair near the tips 630 of cutter knives 624 will be cut in the later part of the cutting stroke. The base 628 and tips 630 of cutter knives 624 correspond in similar fashion to the base 470 and tips 472 of cutter knives 406 as shown in FIG. 4.

During a haircut using automated hair cutting system 100, cutting device 120, and cutter head 600, a portion of long hair 614 may be collected into cutter head 600 through a combing action of cutter head 600 near the scalp 604 so that the location of the collected long hair 614 on scalp 604 is known and a desired length for it may be established based on a desired hair style. For example, desired hair length guide line 616 provides a contour to which long hair 614 is desired to be cut. Hence, once long hair 614 has been collected in cutter head 600, an operator may begin extending cutter head 600 away from scalp 604 to extend the collected long hair 614 in cutter head 600 for cutting.

Various embodiments of automated hair cutting system 100 may begin the extension of hair for cutting in various ways. Some embodiments may detect when hair has been collected into cutter head 600 and may provide the operator with signals as discussed hereinabove (including visual, audible, haptic, or through any other possible signaling techniques) that hair has been successfully collected in cutter head 600 and extension of hair for cutting may begin. Other embodiments or modes of operation may include the operator signaling the automated hair cutting system 100 that hair has been collected in cutter head 600 and that extension of hair for cutting may begin. In some embodiments, even though the operator has lifted hair cutting device 120 away from scalp 604, automated hair cutting system 100 may need this signal from the operator to know a location from which to reference measurements for how long hair is being extended so that it may automatically begin a cutting stroke of cutter head 600. The operator may signal by pressing a button, switch, touch sensitive display, or other input device (that may be on electronic computing device 108, hair cutting device 120, or other system element); by providing a verbal signal that may be received and processed by electronic computing device 108, hair cutting device 120, or other system element; by nudging or bumping hair cutting device 120 in a pre-defined manner (such as momentarily pressing cutter head 600 against scalp 604); or by other possible ways of signaling that hair has been collected in cutter head 600 and that extension of hair for cutting may begin. Some embodiments of cutter head 600 may include a touch sensor that may sense when cutter head 600 has contacted the scalp 604 of user 102. (See Krenik '856 for more description on touch sensors which may be used with the present disclosure.) Some embodiments of touch sensors may additionally measure the distance from cutter head 600 to scalp 604 and some embodiments of touch sensors may also provide information on the level of resilience, compliance, softness, springiness, or other aspects of scalp 604.

As long hair 614 collected in cutter head 600 is extended for cutting, the orientation of cutter head cutting interface guide line 620 relative to desired hair length guide line 616 near cutter head 600 is important. Desired hair length guide line 616 provides the desired length for hair collected in cutter head 600 to be cut. Cutter head cutting interface guide line 620 lies at the interface of cutter knives 624 and comb teeth 626 of cutter head 600 and provides the line along which hair collected in cutter head 600 will be cut if cutter head 600 is rapidly actuated on a cutting stroke. As collected long hair 614 is extended through cutter head 600 as cutter head 600 is lifted away from scalp 604, an intersection point 632 of desired hair length guide line 616 and cutter head cutting interface guide line 620 will progress along cutter head cutting interface guide line 620 and will reach base 628 of cutter knives 624; and, as this occurs, if actuation of a cutting stroke of cutter head 600 is coordinated in time with the extension of hair through cutter head 600 so that the slanted cutting edges of cutter knives 624 and comb teeth 626 meet and begin to pass over each other so that hair near base 628 of cutter knives 624 begins to be cut, then the long hair 614 collected in cutter head 600 near base 628 will be cut. As cutter head 600 is further lifted away from scalp 604 and intersection point 632 further progresses to tip 630 of cutter knives 624, further coordinated actuation of the cutting stroke of cutter knives 624 relative to comb teeth 626 may also progress so that substantially all long hair 614 collected in cutter head 600 is cut substantially to its desired length. Hence, cutter heads 600 with slanted cutting edges may be actuated for cutting in coordination with movement of the cutter head 600 so that as portions of hair collected in cutter head 600 are extended and reach their desired length; that the cutting stroke is so coordinated that those portions of hair are cut substantially to their desired length.

Maintaining the cutter head 600 along desired hair length guide line 616 and cutter head cutting interface guide line 620 enables the collected hair to be cut according to a desired length, programmed into a user interface of automated hair cutting system 100, such that actuation of cutter head 600 is timed accordingly with the extension of hair collected therein. If cutter head 600 is rotated counterclockwise so that intersection point 632 is above tip 630 (that is, above it in the view as shown in FIG. 6) before hair collected in cutter head 600 reaches a length suitable for actuation of a cutting stroke, then the cutting stroke cannot actuate and hair cannot be cut as desired. For the cutting action to be coordinated accordingly with hair extension, intersection point 632 will be positioned beneath base 628 of cutter knives 624 before the long hair 614 collected in cutter head 600 is extended to its desired length for cutting. If cutter head 600 is oriented improperly (so that the hair collected in cutter head 600 does not first reach its desired length at base 628 and progresses instead so that the collected hair reaches its desired length first at the tip 630) then cutter head 600 actuation cannot begin. Automated hair cutting system 100 may signal cutter head 600 and prevent actuation thereof to prevent hair from being cut to an undesired length. Similarly, cutter head may be configured to receive instructions for actuation so that no hair is cut shorter than its desired length and automated hair cutting system 100 may signal to user 102 (through any possible visual, audible, haptic, or other suitable signal) that a sub-optimal cut has occurred. Alternatively, automated hair cutting system 100 may not actuate cutter head 600 at all (so that user 102 realizes an error occurred, or automated hair cutting system 100 may additionally send a visual, audible, haptic or other signal to user 102 to mark the occurrence of the error). In any case, user 102 may then try again to collect long hair 614 in cutter head 600 and attempt a new extension of cutter head 600 away from scalp 604 for cutting hair in an optimal fashion (and potentially improving the orientation of cutter head 600 as it is extended away from scalp 604 so that optimal results are possible).

Some embodiments of automated hair cutting systems may guide user 102 so that as cutter head 600 is extended from scalp 604 to extend collected hair for cutting, the orientation of cutter head 600 allows coordination of a cutting stroke of cutter head 600 with extension of cutter head 600 away from scalp 604 so that optimized hair cutting may take place. While the view shown in FIG. 6 has intersection point 632 below base 628 of cutter knives 624 so that optimal cutting may take place, an operator would need only to alter the orientation of cutter head 600 somewhat to enable optimized cutting if cutter head 600 was initially oriented incorrectly. Embodiments of automated hair cutting system 100 may provide visual, audible, haptic, or other suitable signals to an operator of a hair cutting device 120 to position and move hair cutting device 120 as it is lifted away from scalp 604 so that extension of hair and actuation of cutter head 600 may be coordinated so that hair collected in cutter head 600 may be substantially optimally cut. That is, an operator may be directed to rotate the handle of a hair cutting device 120, including cutter head 600, forward in the direction that the teeth of cutter head 600 are pointing, or rearward in the direction opposite that the teeth of cutter head 600 are pointing. Hair cutting device 120 need not be precisely oriented for such optimal cutting to be achieved. Cutter head 600 may be rotated in various directions, including clockwise at varying angles during a hair cutting process. Actuation of cutter head 600 may still be coordinated with extension of cutter head 600 over some range of orientation of cutter head 600, so the operator need only orient hair cutting device 120 sufficiently within a defined range. If cutter head 600 is rotated clockwise to the point that the teeth of cutter head 600 nearly point directly toward scalp 604, coordinated cutting action of cutter head 600 may still occur; however, collection of hair into cutter head 600 may be difficult, and only small amounts of hair may be collected and extended at a time. Accordingly, embodiments of automated hair cutting system 100 may generally guide operator to orient cutter head 600 over a more limited range of orientation.

Hair cutting device 120 may include a substantially long and straight handle for better orienting cutter head 600 than using a shorter handle. Some embodiments of hair cutting devices may have handles that include a reference feature, handle shape, textured grip, or other feature so that an operator may know the direction that the teeth of cutter head 600 are pointing without having to look at hair cutting device 120, such as on hair cutting device 900 shown in FIG. 9.

Various factors may be included in determining cutter head 600 orientation. For example, desired hair length guide line 616 may be a contour line for certain hair styles. Accordingly, coordinating actuation of cutter head with hair collection and extension may include coordinating the time and speed with which cutter head 600 is actuated relative to the speed at which cutter head 600 is being lifted away from scalp 604, and may include configuring a variable actuation speed. Certain factors may need to be maintained to achieve a desired hair style and length, including the speed at which cutter head 600 is lifted away from scalp 604, the speed and accuracy to which cutter head 600 may be actuated through a cutting stroke, the actual shape of the slanted cutting edges used in cutter head 600, the amount of hair collected in cutter head 600, the level of force required on cutter head 600 to actuate it through a cutting stroke, and other factors. For some embodiments, the operator may be directed to not only alter the orientation of cutter head 600 as it is extended from scalp 604, but to also alter the speed or position of cutter head 600 so that the ability to optimally cut hair is enabled.

Some embodiments of cutter heads may allow independent actuation of cutter knives so that hair may be more optimally cut across the cutting surface of cutter head 600 if cutter head 600 is not optimally oriented, and some embodiments may be configured to disable actuation of cutter head 600 if orientation is not within a desired range. For cutter heads where all cutter knives are actuated together, actuating cutter knives with slanted cutting edges in coordination with controlled orientation and extension of cutter head 600 more optimally cuts hair than would otherwise be possible and relaxes the need for a user 102 to precisely orient cutter head 600. Some embodiments of cutter heads 600 may actuate all cutter knives at once such that all the hair collected in such a cutter head 600 may be cut at once. Some hair styles may require hair to be cut at substantially different lengths over even a relatively small area of scalp 604. And some regions of scalp 604, may be sharply curved (such as where the sides of a user's 102 head curve to form the top of their head, or in other possible regions). As a result, actuation of a cutter head 600 for a cutting stroke, even if the cutting stroke is actuated in coordination with the extension of cutter head 600 may leave some hair inaccurately cut. Some embodiments of automated hair cutting system 100 may compute the length that all hair is being cut to and ensure that cutter head 600 is actuated to ensure none of the hair collected in cutter head 600 is cut too short. That is, actuation of cutter head 600 may be controlled so that as cutter head 600 is lifted away from scalp 604 to extend hair for cutting that hair collected in cutter head 600 is substantially all cut either accurately or somewhat longer than is desired. Automated hair cutting system 100 may keep track of where hair was cut somewhat longer than desired and alert an operator that additional cycles of collecting, extending, and cutting such longer than desired hair is needed to achieve acceptable tolerances for cut hair.

Some hair styles involve creating randomized, feathered, or other features in hair. The embodiment shown in FIG. 6 may allow such features to be included if cutter head 600 is actuated in a somewhat randomized fashion. That is, as the cutter knives 624 and comb teeth 626 of cutter head 600 are actuated to cut hair, some level of reciprocal motion, jittering, dithering, or otherwise randomizing of the motion of cutter knives 624 may be applied so that the resulting cut hair incorporates some randomness or pattern to its length. Cut hair 612 is shown in FIG. 6 as uniformly cut to the length of desired hair length guide line 616. However, if cut hair 612 were cut with patterned or randomized partial actuations of cutter head 600, some of the hairs of cut hair 612 may be slightly longer and others slightly shorter than desired hair length guide line 616. Orientation of cutter head 600, speed of extension, speed and amplitude of actuation, speed and amplitude at which cutter head 600 is actuated reciprocally, and actuation patterns may vary according to hair type and desired style. Different types (straight, curly, etc.), weights (heavy/thick or light/thin), colors (blond, brunette, etc.), shine levels (shiny, dull, etc.), lengths (long, short, etc.), styles, and other factors associated with a user's 102 hair may have impact on which approaches to randomizing or feathering hair may be most desirable. Although some embodiments may comprise teeth in the cutter head 600 extending substantially orthogonal to the main axis and handle of a hair cutting device 120, some embodiments may comprise a smaller angle than 90 degrees such that an operator may hold hair cutting device 120 in a relatively natural and ergonomic position.

Some embodiments of hair cutting devices 120 may include mounts having controls for cutter head 600, such that the mounts receive instructions or signals from the electronic computing device 108 or other elements of an automated hair cutting system 100 to change the orientation of cutter head 600. Accordingly, the received signals or instructions may also begin actuation of cutter head 600 such that cutting the hair is coordinated in time with extension of hair through cutter head 600. Such automatic adjustment of the orientation of cutter head 600 may be done with electric actuators, hydraulic actuators, pneumatic actuators, or other suitable actuation techniques and may be controlled electronically based on information received from automated hair cutting system 100 regarding the orientation of a hair cutting device 120 relative to the head of a user 102. Some embodiments of hair cutting devices that automatically adjust the orientation of their cutter heads may alter the orientation of their cutter head in two or more directions so that both orientation along the length of the teeth of cutter head 600 (as shown in the side view shown in FIG. 6) and across the width of cutter head 600, may be done automatically so that the full cutting surface of cutter head 600 is more optimally oriented for various hair cutting operations. Those skilled in the art will recognize that automatic controls for the orientation of cutter heads may be combined with appropriate compensations to computations for the length of extended hair so that it may be substantially optimally cut.

FIG. 7 shows a side view of a side or back of a scalp 704. Scalp 704 includes cut hair 712, uncut hair 710, and parted hair 714 as shown. Parted hair 714 has been cut to a similar length to cut hair 712, but has been combed or manipulated to create part 716. Cutter head 700 is shown in FIG. 7 and may be similar in construction and have similar features as cutter head 600 and cutter head 400. Tip 708 of cutter head 700 is shown partially inserted into cut hair 712 so that cutter head 700 may be partially actuated to cut some, but not all, of the hair collected in cutter head 700. In this way, cut hair 712 may be thinned. Thinning hair is a common hair styling technique and may be used to reduce the thickness of hair and provide various tapered effects in some hairstyles. The location at which part 716 is formed, the distance into which tip 708 is inserted into cut hair 712, whether hair is thinned near scalp 704 or whether it is thinned after cutter head 700 has been extended away from scalp 704, and the amount to which cutter head 700 is actuated to partially cut collected hair will factor in to desired results. Automated hair cutting system 100 may recommend where and how hair may be thinned and may also allow user 102 to thin hair as they desire to provide a customized style. For example, automated hair cutting system 100 may stop all actuation of cutter head 700 and allow user 102 to use cutter head 700 as a comb (with cutter knives substantially positioned on top of comb teeth so that hair may flow smoothly through cutter head 700), and utilize the positioning and orientation measuring capability of automated hair cutting system 100 to help user locate part 716 in a desirable place on their scalp. Automated hair cutting system may then direct user for how far to insert tip 708 into cut hair 712 and signal to user when tip 708 is properly inserted into cut hair 712. Automated hair cutting system may then thin hair at user's 102 scalp 704 while cutter head 700 is substantially stationary, or may direct the operator to lift cutter head 700 away from their scalp 704 so that thinning may take place along the length of cut hair 712 (possibly at several locations or even distributed substantially continuously along the length of cut hair 712). Once hair has been thinned above part 716, automated hair cutting system 100 may direct the operator to form a new part an appropriate distance above part 716 so that an additional cycle of hair collection and thinning may occur. Alternatively, the operator may form a part 716 with a comb or other tool for manipulating hair at a desired location on their scalp and may insert tip 708 into part 716 (with tip 708 at the parting line between parted hair 714 and cut hair 712) so that automated hair cutting system 100 may determine the location of part 716 on scalp 704. User 102 or the operator may then input into a user interface the amount of their hair to be thinned and whether it is to be thinned at the scalp, tapered along the full length, or otherwise thinned in another desired way (for example, user 102 may want 10% of their hair to be thinned out at the scalp). Automated hair cutting system 100 may then direct the operator to insert tip 708 a correct amount into cut hair 712 and undertake the desired thinning operation.

Figure 8:
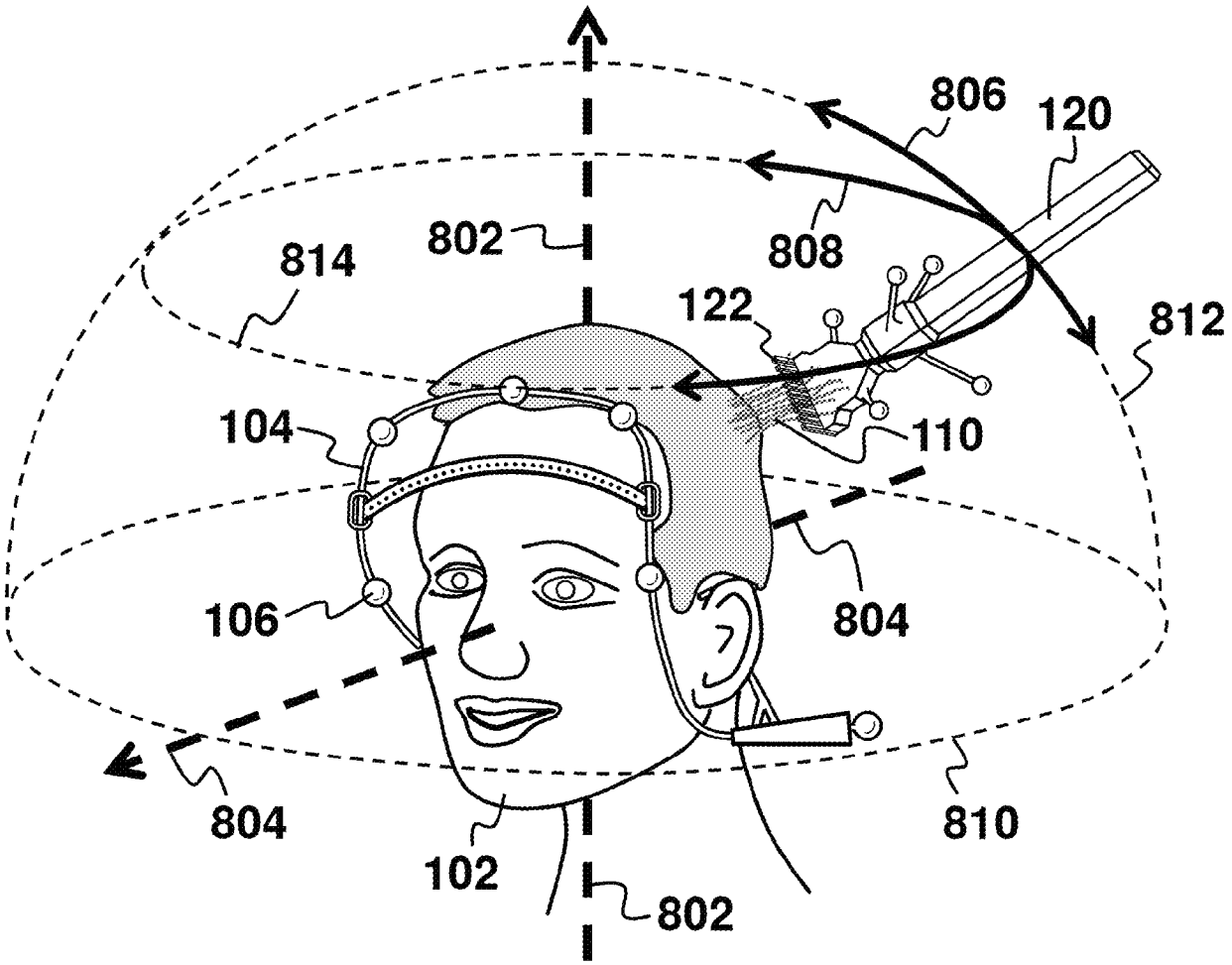
FIG. 8 is a perspective view of another embodiment of an automated hair cutting system using an axis system.

FIG. 8 shows user 102 wearing positioning device 104 in conjunction with hair cutting device 120. FIG. 8 includes imaginary horizontal axis 804 extending from the back center of user's 102 head forward through user's 102 nose and pointed forward in the direction user 102 would look straight forward; and imaginary vertical axis 802 extending vertically through the center of user's 102 head and pointing directly upwards. Circle 810 surrounds user 102 and intersects imaginary horizontal axis 804 both in front of and behind user's 102 head. Circle 814 encircles user's 804 head and the handle of hair cutting device 120. Circle 810 and circle 814 may be used to define lines of latitude (i.e. parallels as are used on a common earth globe) around user's 102 head. Half-circle 812 as shown in FIG. 8 intersects circle 810, circle 814, the handle of hair cutting device 120, and imaginary vertical axis 802 above user's 102 head. Half-circle 812 loops over the top of user's 102 head and may be used to define a line of longitude (i.e. a meridian as are used on a common earth globe) around user's 102 head. Additional circles or half-circles extending over user's 102 head and through imaginary vertical axis 802 may be used to define additional lines of longitude (i.e. meridians).

As noted above with regard to FIGS. 5-7, many hair cutting operations involve collecting hair in a cutter head, such as cutter head 122 of hair cutting device 120 as shown in FIG. 8, and extending hair for cutting (or thinning, tapering, or other hair cutting operations). During a hair cutting operation, an operator may need to collect hair from specific areas of the head and move hair cutting device 120 within a range of positions and a range of orientations to cut hair. Accordingly, automated hair cutting system 100 may send signals for positioning and orienting hair cutting device 120. For the embodiment shown in FIG. 8 only two axes, imaginary horizontal axis 804 and imaginary vertical axis 802 are used to provide a simple and intuitive system so that simple signals and instructions to an operator, such as user 102, may be easily interpreted. For example, if the operator is holding and manipulating hair cutting device 120, but the orientation of hair cutting device 120 is incorrect, a simple audible command of "UP" delivered from electronic computing device 108 may direct the operator to rotate the handle of hair cutting device 120 upwards along meridian arc 806 toward the top center of their head. A simple audible command of "FORWARD" may direct the operator to rotate the handle of hair cutting device 120 forward toward the nose in a direction similar to parallel arc 808. Note that parallel arc 808 lies on circle 814 and meridian arc 806 lies on half-circle 812. Visual signals may also be used by automated hair cutting system 100 and, as an example, an image similar to that provided in FIG. 8 may be displayed on electronic computing device 108 with the direction to rotate the handle of hair cutting device 120 along parallel arc 808 and meridian arc 806 highlighted with bring colors, flashing lights, or other indicators to make the desired directions of rotation of the handle of hair cutting device 120 clear. Instead of audible verbal commands such as "UP" and "FORWARD", some embodiments of automated hair cutting system 100 may make use of audible signals using variable volume, pitch, or other variable patterns to indicate how a user 102 may manipulate hair cutting device 120. For example, a chime signal may change pitch and send a higher pitched signal to indicate to user 102 to rotate hair cutting device 120 upwards along meridian arc 806 and a lower pitched signal to indicate to user 102 to rotate hair cutting device 120 away from the top of their head. The chime signal may get louder to indicate to user 102 to rotate hair cutting device 120 forward toward their nose along parallel arc 808 and softer to indicate to user 102 to rotate hair cutting device 120 toward the back of their head along parallel arc 808. Haptic signals may also be used with vibration amplitudes, frequencies, and patterns of hair cutting device 120 providing signals felt by user 102 as they manipulate hair cutting device 120 to indicate directions for how hair cutting device 120 may be rotated. Those skilled in the art will recognize that a very broad range of audible signals, visual signals, haptic signals, and other possible signals may be used, and may also be used in conjunction with other signals or instructions according to the preferences input by the operator.

While FIG. 8 uses an axis system, some embodiments of automated hair cutting system 100 may provide signals to a user 102 for how to position or orient a hair cutting device 100 with no reference at all to imaginary axes or other orientation references, such as positioning ranges, and other positioning methods discussed herein. For example, if the operator feels a mild haptic vibration signal from hair cutting device 120, it may mean that the orientation of hair cutting device 120 needs to be corrected. The operator may have reason to believe that they are holding the handle of hair cutting device 120 too high (too near the top center of their head) and may lower the handle in an attempt to correct the situation. If the haptic vibration signal from hair cutting device 120 reduces in strength, this may signal that cutting device 120 is moving in a direction that is closer to the desired orientation. Signaling, such as haptic vibration may change according to the movement of hair cutting device 120, indicating to the operator whether the hair cutting device is being moved correctly according to the desired result. In some embodiments, detailed information may be provided on the display screen of electronic computing device 108 while signals, such as haptic signals are used to guide the operator, so that if the operator is not clear on which direction to rotate the handle of hair cutting device 120, that they may look to electronic computing device 108 for visual (and also possibly audio) information and guidance.

In addition to providing direction to a user 102 or operator for how to orient hair cutting device 120, signals may be provided for where to collect hair. These signals may be additional signals to those used to provide directions regarding the orientation of hair cutting device 120, or may be the same or similar signals to those used to provide directions on orienting hair cutting device 120. In the case that the same or similar signals are used, electronic computing device 108 or other elements providing signals and guidance may be used to direct whether orientation or position for collection of hair is being directed at a given time. And automated hair cutting system 100 may also provide direction to user on how hair cutting device 120 may be rotated so that the teeth of hair cutting device 120 point in a favorable direction. Audible, visual, haptic, or other signals may be used to convey appropriate directions for all aspects for the location and orientation of hair cutting device 120.

Figure 9:
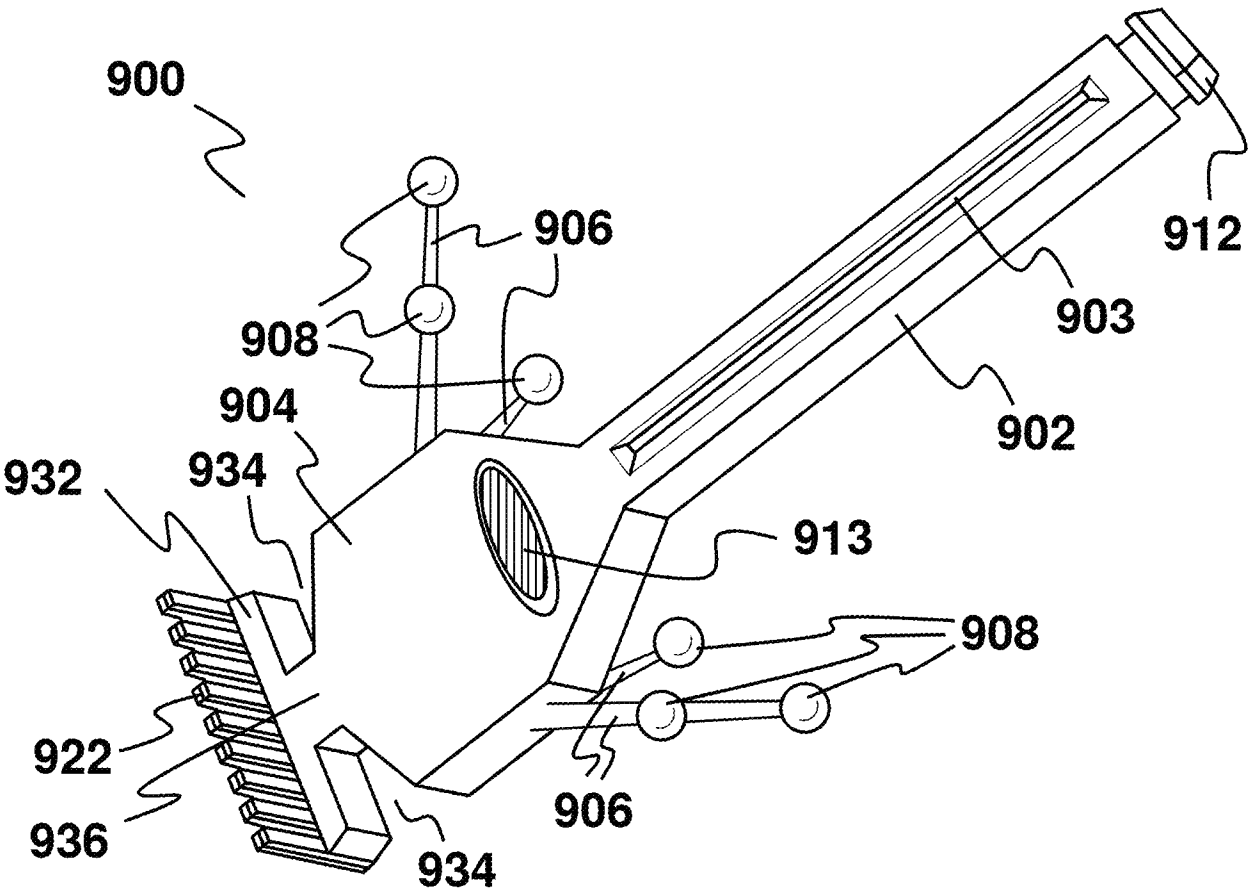
FIG. 9 is a perspective view of a cutting device according to the present disclosure.

FIG. 9 shows an embodiment of a hair cutting device 900. Hair cutting device 900 comprises a handle 902 having a center body 904, a distal center body 936 with a cutter head 922 coupled thereto and an end button 912 and main button 913 at a proximal end thereof. The center body 904 comprises a plurality of sensors 908 coupled to the center body 904 via a plurality of mounting posts 906. Cutter head 922 is mounted on cutter head base 932 at the distal end of the distal center body 936 with relief areas 934 on either side thereof. Relief areas 934 provide openings around cutter head 922 for manipulation around ears and other facial features. Sensors 908 are similar in construction and function to sensors 123 of FIG. 1. While a user 102 may access electronic computing device 108 to provide input and receive signals, a user 102 may be engaged in cutting their hair and observing themselves in a mirror; and looking to electronic computing device 108 may be distracting. Accordingly, some embodiments of hair cutting devices may include buttons, switches, touch interfaces, electrical control knobs, or other features that allow a user 102 to interface with automated hair cutting system 100. Main button 913 and end button 912 may be configured to send one or more signals to a user interface of automated hair cutting system 100, regardless of which is pressed, so that user 102 may access whichever of the buttons is most convenient for them to reach based on how hair cutting device 900 is being manipulated at a given time. For other hair cutting operations, or in other embodiments, main button 913 and end button 912 may serve different purposes. For example, end button 912 may be used for signals from user 102 related to operation of hair cutting device 900 and automated hair cutting system 100, while main button 913 is reserved and always serves as a safety stop button, wherein main button 913 would be configured to stop action of cutter head 922 immediately when pressed.

In other embodiments, main button 913 and/or end button 912 may serve different purposes at different times during a haircut. For example, main button 913 may be used at some times to indicate that hair is collected in cutter head 922 and extension of hair for cutting may commence; but an additional press of main button 913 at this point may signal that cutter head 922 is to be disabled and cutter knives returned to a rest position above comb teeth (so that cutter head 922 may be easily removed from a user's 102 hair). In yet another embodiment, pressing and holding main button 913 in a depressed position may indicate that hair is collected in cutter head 922 and extension of hair for cutting may commence; and a release of main button 913 may indicate that cutter head 922 is to be disabled (that is, cutter head 922 may only be actuated for cutting while main button 913 remains depressed for such an embodiment). Some embodiments may further include an indicator light (or lights) on hair cutting device 900 and such lights may be configured to be visible when viewed in a mirror, wherein the light(s) indicate various signals while operating the automated hair cutting system 100. A variety of shapes, sizes, and placements of buttons, switches, knobs, touch sensitive surfaces, and other user input devices may be used for signaling and controlled hair cutting device 900 or automated hair cutting system 100.

Handle 902 of hair cutting device 900 includes ridge 903. Ridge 903 comprises an elevated ridge along a portion of handle 902 in the direction that the teeth of cutter head 922 point. As a user 102 operating automated hair cutting system 100 may primarily concentrate on their face and hair as they look into a mirror as they cut their hair, user 102 can better determine the direction cutter head 922 teeth are pointing without having to look at hair cutting device 900 by feeling ridge 903. Ridge 903 on handle 902 provides user 102 with a reference of the orientation of hair cutting device 900 (and accordingly, the direction the teeth of cutter head 922 point) while holding hair cutting device 900. As hair cutting device 900 is manipulated about the head of a user 102 during a haircut, ridge 903 may provide an orientation reference for user 102 by feeling the location of ridge 903. Ridge 903 may be formed from metals, wood, plastics, or other materials and may be formed with handle 902 or may be formed separately and then affixed to handle 902. Other orientation references such as variations in the shape, texture, and size of handle 902 and ridge 903 may be used.

A cutter head of a hair cutting device may be tilted so that the cutter head tips slide over a scalp while the cutter head is actuated so that a closer cutting or shaving action than may otherwise be possible is achieved. The operator may be guided to orient a hair cutting device so that hair collected near the base region of a cutter head (near where the cutter knives and comb teeth first meet when the cutter head is actuated to cut hair) may be cut first and hair near the tips of the cutter head may be cut later, so that hair is cut substantially accurately as the hair cutting device is manipulated to extend hair for cutting. The tips of a cutter head may be inserted into hair, possibly along a part that has been combed into the hair, so that thinning, feathering, layering, or other such desired effects maybe produced.

Operation of an automated hair cutting system may involve an operator interacting with an electronic computing device, a positioning device, a hair cutting device, and possibly with other elements that may be present in some embodiments of automated hair cutting systems. Some users of automated hair cutting systems may prefer to observe themselves in a mirror as they are cutting their hair. Especially for an operator giving themselves a haircut, it is important to be able to operate the automated hair cutting system in a simple and intuitive way. An automated hair cutting system may guide the operator with sound, visual, haptic, and other forms of signals to guide the user to manipulate a hair cutting device. Imaginary coordinate axes may be introduced that extend vertically and horizontally through the haircut recipient's head (or in other locations or directions), and sound signals or other signals may direct a user to orient a hair cutting device relative to these axes during providing a haircut. Visual images on the screen of an electronic computing device may be provided in conjunction with audible sound signals, haptic signals, or other signals so that a user may respond both to a visual image and to sound signals, haptic signals, other signals, or combinations of signals. Buttons, knobs, touch sensitive areas, switches and other interfaces allowing the operator to send signals to an automated hair cutting system may be provided on a hair cutting device. A ridge, groove, or other physical feature may be added to a hair cutting device so that the operator may determine the direction the teeth of a cutter head are pointing based on touching the hair cutting device.

Those skilled in the art to which the present disclosure relates will appreciate that other and further additions, deletions, substitutions and modifications may be made to the described embodiments.

The invention claimed is:

1. A cutting device for use with an automated hair cutting system, comprising:

a handle having a proximal and distal end;

a cutting head positioned near the distal end of the handle, the cutting head comprising:

a cutting instrument, said cutting instrument having a plurality of cutter knives, said cutter knives configured having:

a first surface extending to a second surface and forming a sharp edge therebetween; and a contoured surface extending from the second surface to the first surface; and a comb coupled proximate the cutting instrument, said comb having a first and second end and a plurality of teeth positioned therebetween, wherein the plurality of teeth and at least one of the first and second end have:

a first surface extending to a second surface and forming a sharp edge therebetween; and a contoured surface extending from the second linear surface to the first surface;

wherein the sharp edges of the cutter knives are configured to slidingly engage the sharp edges of the plurality of teeth when the cutting instrument is actuated; and at least one positioning sensor secured to the cutting device and configured to interact with a positioning device that is configured to be secured to a head of a user and having a positioning interface, said interaction comprising at least one signal indicating the position of the cutting head relative to the positioning interface.

2. The cutting device according to claim 1, further comprising at least one button, said at least one button configured to receive input from an operator of the cutting device.

3. The cutting device according to claim 2, wherein the at least one button is configured to initiate a signal that hair is collected in said cutter head when said at least one button is depressed and to immediately stop actuation of said cutting instrument when said at least one button is released.

4. The cutting device according to claim 1, wherein the handle comprises at least one positioning guidance ridge extending between the distal and proximal ends.

5. The cutting device according to claim 1, wherein said automated hair cutting system further comprises a computing device comprising a user interface configured to receive inputs from an operator of the cutting device.

6. The cutting device according to claim 5, wherein the computing device is configured to receive the at least one signal indicating the position of the cutting head relative to a surface having hair extending therefrom and prepare instructions for an operator using the cutting device.

7. The cutting device according to claim 6, wherein the instructions indicate one or more movements of the cutting device for cutting hair to a specified length.

8. The cutting device according to claim 6, wherein the instructions indicate a time to actuate the cutting instrument to coordinate a cutting stroke with the position of the cutting head relative to a surface having hair extending therefrom.

9. The cutting device according to claim 1, wherein the at least one sensor is configured to send a signal indicating that hair is collected in the cutting head.

10. The cutting device according to claim 5, wherein the computing device is configured to receive a signal indicating that hair is collected in the cutting head and prepare instructions for an operator using the cutting device.

11. The cutting device according to claim 10, wherein the instructions indicate one or more movements of the cutting device for cutting hair to a specified length.

12. The cutting device according to claim 10, wherein the instructions indicate a time to actuate the cutting instrument to coordinate a cutting stroke with the position of the cutting head relative to a surface having hair extending therefrom.

13. An automated grooming system, comprising:

a computing device; and a cutting device comprising:

a handle having a proximal and distal end;

a cutting head positioned near the distal end of the handle, the cutting head comprising:

a cutting instrument, said cutting instrument having a plurality of cutter knives, said cutter knives configured having:

a first surface extending to a second surface and forming a sharp edge therebetween; and a contoured surface extending from the second linear surface to the first surface;

a comb coupled proximate the cutting instrument, said comb having a first and second end and a plurality of teeth positioned therebetween, wherein the plurality of teeth and at least one of the first and second end have:

a first surface extending to a second surface and forming a sharp edge therebetween; and a contoured surface extending from the second linear surface to the first surface;

wherein the angled edges of the cutter knives are configured to slidingly engage the angled edges of the plurality of teeth when the cutting instrument is actuated; and at least one positioning sensor secured to the cutting device and configured to interact with a positioning device that is configured to be secured to a head of a user and having a positioning interface, said interaction comprising at least one signal indicating the position of the cutting head relative to the positioning interface.

14. The automated grooming system according to claim 13, wherein the computing device comprises a user interface configured to receive inputs from an operator and prepare instructions for the operator, wherein the instructions indicate a direction in which to move the cutting device.

15. The automated grooming system according to claim 13, wherein the at least one sensor is configured to send a signal to the computing device, the signal indicating that hair is collected in the cutting head.

16. The automated grooming system according to claim 15, wherein the computing device is configured to receive the signal indicating that hair is collected in the cutting head and prepare instructions for an operator using the cutting device.

17. The automated grooming system according to claim 16, wherein the instructions indicate one or more movements of the cutting device for cutting hair to a specified length.

18. The automated grooming system according to claim 16, wherein the instructions indicate a time to actuate the cutting instrument to coordinate a cutting stroke with the position of the cutting head relative to a surface having hair extending therefrom.

19. An automated grooming system, comprising:

a computing device;

a cutting device comprising a handle having a proximal and distal end and a cutting head positioned near the distal end of the handle, the cutting device further comprising at least one positioning sensor secured to the cutting device; and a positioning device comprising:

a frame configured to securely engage with a head of a user;

a plurality of positioning interfaces secured to the frame and configured to interact with the at least one sensor secured to the cutting device, said interaction determining a position of the cutter head relative to the positioning device;

wherein the computing device is configured to receive a signal from at least one of the positioning device and the cutting device, that relays the position of the cutting head relative to the positioning device, and prepare instructions for actuation of the cutting device.

20. The automated grooming system according to claim 19, wherein the cutting device comprises a processor configured to receive the prepared instructions from the computing device and actuate the cutting device according to the prepared instructions.

* * * * *